United States Patent [19]

Porter

[11] 4,016,909

[45] Apr. 12, 1977

[54] DEVICE FOR FASTENING THE REED TO THE SLAY OF A LOOM

[75] Inventor: Allan William Henry Porter, Lustmuhle, Switzerland

[73] Assignee: Aktiengesellschaft Adolph Saurer, Arbon, Switzerland

[22] Filed: Jan. 16, 1976

[21] Appl. No.: 649,688

[30] Foreign Application Priority Data

Jan. 24, 1975 Switzerland ..... 00899/75

[52] U.S. Cl. ..... 139/188 R; 139/192

[51] Int. Cl.[2] ..... D03D 49/60; D03D 49/62

[58] Field of Search ..... 139/188–192

[56] References Cited

UNITED STATES PATENTS

| | | | |
|---|---|---|---|
| 499,870 | 6/1893 | Cheney | 139/188 R |
| 2,109,444 | 2/1938 | Jackson | 139/188 R |
| 2,775,985 | 1/1957 | Schmidt | 139/188 R |
| 3,670,776 | 6/1972 | Demuth | 139/188 R |
| 3,770,024 | 6/1973 | Pfarrwaller | 139/188 R |

FOREIGN PATENTS OR APPLICATIONS

| | | | |
|---|---|---|---|
| 80,068 | 1/1951 | Czechoslovakia | 139/192 |
| 775,869 | 10/1934 | France | 139/188 R |
| 201,730 | 8/1923 | United Kingdom | 139/188 R |

*Primary Examiner*—James Kee Chi

*Attorney, Agent, or Firm*—Ostrolenk, Faber, Gerb & Soffen

[57] ABSTRACT

The beam of the slay of a loom is a hollow rectangle in cross-section; the reed is held against the outside of one wall of the slay beam; the reed comprises reed blades, whose opposite ends are each embedded in a hardenable compound in the bends of a pair of oppositely disposed, facing U-rails; a plurality of holes arrayed along and passing through one rib and the slay beam wall; at each hole a fastening means supports a flange that presses against the outside of the rib; each flange is generally rhombus shaped and curved to be flattened by tightening.

10 Claims, 3 Drawing Figures

3
15
1
9
12
I
2
11
4
5
7
I

DEVICE FOR FASTENING THE REED TO THE SLAY OF A LOOM

BACKGROUND OF THE INVENTION

The invention concerns a device for fastening the reed to the slay of a loom. The device of the invention uses pressure plates for pressing a support rib for the reed against the end face of the slay.

A conventional reed comprises individual, regularly spaced reed blades which have ends that are located in the interior pockets of U-rails. The U-rails are usually formed of aluminum. The reed blades are embedded in a hardenable plastic compound in the U-rails. The strength of such a reed in the striking direction is determined by the strength of the U-rail. With the U-rail orientation and profile conditions normally found in practice, the strength of the reed is relatively small. As a result, the reed must be reinforced by means of stronger clamp rails which extend over the entire length of the reed and of the U-rail and are screwed on or otherwise secured. The clamp rails add undesirable weight to the reciprocating slay.

SUMMARY OF THE INVENTION

An object of the invention is to eliminate the above noted inconvenience of clamp rails by providing a lower weight arrangement for fastening the reed to the slay.

Another object of the invention is to apply uniform pressure upon the reed as it is fastened to the slay.

These objects are achieved by providing pressure flanges to engage one supporting rib of the reed and to press the rib against the rear wall of the slay beam. Each pressure flange extends across and beyond the edges of a respective aligned hole passing through the rib and the rear wall of the slay beam. In order to better secure the reed and to align it on the slay beam, each pressure flange is connected to a sleeve of the pressure flange, and this sleeve is inserted into the aligned hole through the rib of the reed and the side wall of the slay beam. A fastening bolt passes from inside the slay beam through a receiving bore in the sleeve of the pressure flange.

Because the pressure flanges bear directly on the rib of the reed, prior art clamp rails, with their heavy weight, can be eliminated.

In order to distribute the pressure of all pressure flanges over the entire length of the reed rib without interruption and to enhance thus the support of the reed blades in the U-rails of the ribs, these pressure flanges are preferably so shaped and dimensioned that they abut each other in the longitudinal direction of the slay beam. The pressure exerted by the rib against the rear wall of the slay beam becomes more uniform if the bearing surfaces of two adjacent pressure flanges overlap in the longitudinal direction of the slay beam. This is achieved by the pressure flanges each having substantially the form of a rhombus. Two of the opposite sides of the rhombus extend parallel to the longitudinal edges of the rib. The other two of sides are so inclined that they extend across at least two adjacent reed blades. Preferably, the pressure flanges are precurved or prebent around the axis of the slay beam and are concave toward the slay so that the pressure exerted by the flanges is uniformly distributed when the flanges are flattened against the rib under the tightening of the fastening bolt.

BRIEF DESCRIPTION OF THE DRAWINGS

A preferred embodiment of the arrangement according to the invention is shown in the drawings.

DETAILED DESCRIPTION OF A PREFERRED EMBODIMENT

Figure 1:
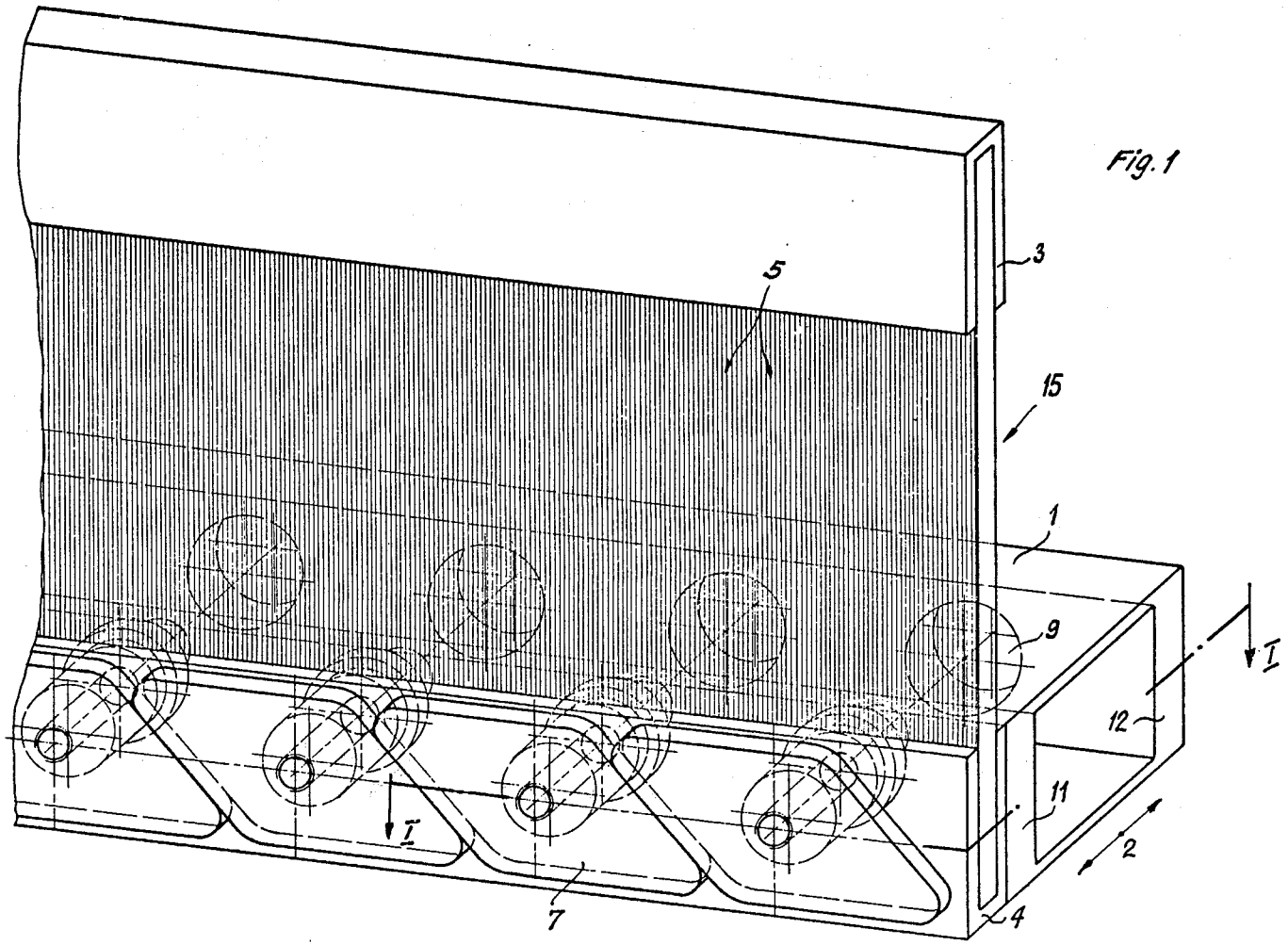
FIG. 1 shows a perspective view of one end of a reed secured on a slay beam
Figure 2:
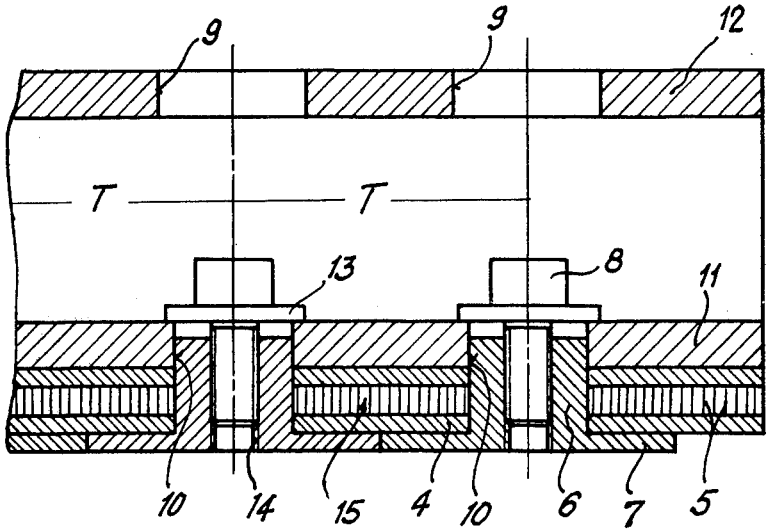
FIG. 2 shows a top view of a section through the slay beam in the plane I—I according to FIG. 1.

The drawings show a slay beam 1 which reciprocates along the path indicated by the double arrow 2. The slay beam is part of a slay (not shown) of a loom (not shown). The slay beam 1 has a particularly rigid, rectangular, hollow, closed profile. The reed 15, comprised of reed blades 5 and ribs 3 and 4 are to be attached to slay beam 1.

An upper rib 3, designed as a U-rail, is provided. A lower rib 4, likewise designed as a U-rail, is also provided and is spaced from rib 3. The U-rail openings face toward each other. Rib 4 is positioned adjacent to rear wall 11 of slay beam 1.

A plurality of reed blades 5 of reed 15 are arrayed at regular intervals along ribs 3, 4. The reed blades project into the U-openings of the ribs and the ends of the reed blades are embedded in a hardenable compound which is cast into the interiors of the U-openings.

At regular intervals T, pressure flange sleeve receiving holes 10 are provided in the rear wall 11 of the slay beam. There are correspondingly positioned holes through rib 4 that are alignable with holes 10. A plurality of sleeves 6, each integrally connected to and projecting from a surface of a respective pressure flange 7 and each sleeve having a threaded bore 14, are provided. Each sleeve 6 passes through rib 4 and the lower ends of the reed blades 5 that are embedded in the interior of rib 4. The holes 10 and the holes through rib 4 provide for as little radial play as possible for each sleeve 6.

Each pressure flange 7 is substantially a rhombus in shape. It has a top and bottom side extending along the length axis of the slay beam. Its other two sides abut the corresponding sides of the adjacent pressure flanges. The other sides of each rhombus are inclined at an angle selected such that and those sides are of a length such that those sides extend longitudinally of the slay beam a distance sufficient for each side to extend over a plurality of the reed blades 5. At the abutting edges of each pressure flange, therefore, there is overlapping pressure by the abutting flanges 7 on the reed blades 5 that are covered over. This helps to ensure uniform application of pressure on the reed blades out to the edges of the flanges 7.

Figure 3:
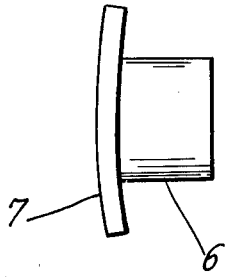
FIG. 3 is a side edge elevational view through a pressure flange illustrating its shape before the securement.

As shown in FIG. 3, each flange 7 is originally precurved around the axis of the slay beam and it is mounted with its concave surface toward the slay beam. Upon tightening of the flange to the slay beam, its material is resilient and sufficiently flexible to enable the flange to deform flat. Yet the material is sufficiently rigid that the deformed flange uniformly distributes pressure across the rib and the reed.

A bolt 8, with a collar or washer 13 at its head, is tightened into matingly threaded bore 14 of sleeve 6 until collar 13 bears on the inner surface of slay beam rear wall 11. This draws flange 7 against rib 4, and tightens and flattens the flange. Rib 4 is pressed by flanges 7 and by reed blades 5 against the outer face of the rear slay wall 11. Tightening of bolts 8 can be effected through access openings 9 provided in the front wall 12 of the slay beam 1.

Although there has been described a preferred embodiment of this novel invention, many variations and modifications will now be apparent to those skilled in the art. Therefore, this invention is to be limited not by the specific disclosure herein, but only by the appending claims.

I claim:

1. Device for fastening the reed of a loom onto the elongated slay beam of the loom, comprising: a slay beam having a longitudinal axis extending along the length of a row of reed blades; a reed comprising a plurality of reed blades arrayed in a row and an elongated rib on which one end of each said reed blade is supported; a hardenable compound placed along said rib and in which all said reed blade one ends are embedded to form an integral unit among said reed blades and said rib; said rib being positioned adjacent to said slay beam; a plurality of pressure flanges arrayed in a row along said rib on the side thereof away from said slay beam; said pressure flanges being shaped and located along said rib such that a said pressure flange is over every said reed blade; pressure flange fastening means securing said pressure flanges against said rib and said rib against said slay beam, thereby squeezing said rib against said slay beam.

2. The device for fastening the reed of a loom of claim 1, wherein said pressure flanges are each substantially in the form of a rhombus, with the first two opposite sides of each said flange being along the direction of said axis of said slay beam and with the other two opposite sides of each said flange being near to a neighboring said other side of a neighboring said flange; in the direction along said slay beam axis, the said flange other sides of adjacent flanges overlap.

3. The device for fastening the reed of a loom of claim 2, wherein said other opposite sides of neighboring said pressure flanges abut each other.

4. The device for fastening the reed of a loom of claim 2, further comprising a respective sleeve extending from a surface of each said flange; for each said sleeve, a respective aligned hole is provided through said rib and said slay beam and each said sleeve extending through its said aligned holes; each said aligned hole being narrowed to permit little radial play of said sleeve therein; said fastening means comprising means engaging and tightening to said sleeve and thereby drawing said flanges against said rib.

5. The device for fastening the reed of a loom of claim 4, wherein said fastening means comprises a bolt and said sleeve including a bore for receiving said bolt; such that tightening of said bolt into said sleeve presses said flange against said rib.

6. The device for fastening the reed of a loom of claim 2, wherein each said pressure plate is generally curved in shape around said slay beam and the concave side of the curvature faces toward said rib, and said flange being of a material to resiliently deform flat under the tightening of said fastening means to apply uniform pressure on said rib.

7. The device for fastening the reed of a loom of claim 2, wherein in the direction along said slay beam axis, said flange other sides extend across a plurality of said reed blades.

8. The device for fastening the reed of a loom of claim 3, wherein in the direction along said slay beam axis, said flange other sides extend across a plurality of said reed blades; each said pressure plate is generally curved in shape around said slay beam and the concave side of the curvature faces toward said rib, and said flange being of a material to resiliently deform flat under the tightening of said fastening means to apply uniform pressure on said rib.

9. The device for fastening the reed of a loom of claim 8, further comprising a respective sleeve extending from a surface of each said flange; for each said sleeve, a respective aligned hole is provided through said rib and said slay beam and each said sleeve extending through its said aligned holes; each said aligned hole being narrowed to permit little radial play of said sleeve therein; said fastening means comprising means engaging and tightening to said sleeve and thereby drawing said flanges against said rib.

10. The device for fastening the reed of a loom of claim 1, wherein said rib is U-shaped and has an opening in its U-shape, said hardenable compound is in said opening of said rib and said reed blades extend into said opening in said rib and are received and held in said hardenable compound.

* * * * *